US008627547B2

(12) United States Patent
Soh

(10) Patent No.: US 8,627,547 B2
(45) Date of Patent: Jan. 14, 2014

(54) INVISIBLE HINGE WITH INTERNAL ELECTRICAL WIRING

(75) Inventor: Kok Leong Soh, Singapore (SG)

(73) Assignee: Universal Industrial Products, Inc., Pioneer, OH (US)

( * ) Notice: Subject to any disclaimer, the term of this patent is extended or adjusted under 35 U.S.C. 154(b) by 186 days.

(21) Appl. No.: 13/318,575

(22) PCT Filed: May 6, 2010

(86) PCT No.: PCT/US2010/033878

§ 371 (c)(1), (2), (4) Date: Dec. 16, 2011

(87) PCT Pub. No.: WO2010/129778

PCT Pub. Date: Nov. 11, 2010

(65) Prior Publication Data

US 2012/0090135 A1 Apr. 19, 2012

Related U.S. Application Data

(60) Provisional application No. 61/176,531, filed on May 8, 2009.

(51) Int. Cl.
*E05D 15/00* (2006.01)

(52) U.S. Cl.
USPC ..... 16/369; 16/379; 16/298; 439/31; 439/165; 49/398

(58) Field of Classification Search
USPC ..... 16/250, 251, 298–301, 288, 358, 370, 16/379, 72, 282, 294, 369; 49/398; 439/31, 165; 200/61.7
See application file for complete search history.

(56) References Cited

U.S. PATENT DOCUMENTS

| | | | | | |
|---|---|---|---|---|---|
| 615,209 | A | * | 11/1898 | Baxter | 439/31 |
| 882,721 | A | * | 3/1908 | Soss | 16/68 |
| 1,687,271 | A | * | 10/1928 | Soss | 16/358 |
| 1,984,092 | A | * | 12/1934 | Soss | 16/369 |
| 2,688,733 | A | * | 9/1954 | Walter, Jr. | 439/31 |
| 3,001,224 | A | * | 9/1961 | Soss | 16/276 |
| 3,004,280 | A | * | 10/1961 | Stein | 16/54 |
| 3,838,234 | A | * | 9/1974 | Peterson | 200/61.7 |
| 3,842,386 | A | * | 10/1974 | Suska | 439/31 |
| 3,857,625 | A | * | 12/1974 | Crane et al. | 439/31 |
| 3,903,567 | A | | 9/1975 | Suska | |
| 3,975,791 | A | | 8/1976 | Hettich et al. | |
| 4,083,082 | A | * | 4/1978 | Holmes | 16/288 |
| 4,116,514 | A | * | 9/1978 | Lawrence | 439/31 |

(Continued)

OTHER PUBLICATIONS

International Search Report and Written Opinion for PCT/US2010/033878 mailed Jan. 3, 2011; ISA/KR.

*Primary Examiner* — William Miller
(74) *Attorney, Agent, or Firm* — Harness Dickey & Pierce, P.L.C.

(57) ABSTRACT

A self-closing invisible hinge for returning a door to its closed position from its opened position including a self-closing structure in which the closing force can be selectively adjusted externally at the hinge and in which the self-closing structure is compact. The self-closing invisible hinge further having an embedded wiring system for providing electrical communication between an area on or in the door and an area adjacent a mounting structure supporting the door, such as a building electrical and/or communication system.

24 Claims, 6 Drawing Sheets

(56) References Cited

U.S. PATENT DOCUMENTS

| | | | | | |
|---|---|---|---|---|---|
| 4,140,357 | A * | 2/1979 | Wolz et al. | 439/31 |
| 4,412,711 | A * | 11/1983 | Suska | 439/31 |
| 4,875,252 | A | 10/1989 | Falconer et al. | |
| 5,727,960 | A * | 3/1998 | Zehrung | 439/165 |
| 6,487,755 | B1 * | 12/2002 | Caldari | 16/370 |
| 7,063,042 | B2 * | 6/2006 | Dillingham | 16/354 |
| 7,824,200 | B2 * | 11/2010 | Bryla et al. | 439/165 |
| 8,307,509 | B2 * | 11/2012 | Schau | 16/354 |
| 8,490,249 | B2 * | 7/2013 | Boegel-Poetter et al. | 16/386 |
| 2004/0173327 | A1 | 9/2004 | Steel et al. | |

* cited by examiner

INVISIBLE HINGE WITH INTERNAL ELECTRICAL WIRING

CROSS-REFERENCE TO RELATED APPLICATIONS

This application is a 371 U.S. National Stage of International Application No. PCT/US2010/033878, filed May 6, 2010, and claims the benefit of U.S. Provisional Application No. 61/176,531. filed May 8, 2009, the disclosures of which are herein incorporated by reference in their entirety.

FIELD

The present disclosure relates to a self-closing invisible hinge having internal wiring for transmitting electrical current.

BACKGROUND AND SUMMARY

This section provides background information related to the present disclosure which is not necessarily prior art. This section also provides a general summary of the disclosure, and is not a comprehensive disclosure of its full scope or all of its features.

The invisible hinge of the present teachings is generally of the type shown in U.S. Pat. No. 1,687,271 issued on Oct. 9, 1928 to J. Soss. The advantages of the invisible hinge of the type noted are well known in the art. However, in some applications, it is desirable that the hinge be self-closing. A self-closing structure for such a hinge is shown in the U.S. Pat. No. 3,004,280 issued on Oct. 17, 1961 to J. P. Stein. That structure, however, utilizes a complex hydraulic piston and spring combination in which regulation of the closure and latching rates are controlled via adjustable valves. The valves are a part of the hydraulic mechanism which is mounted in a cavity in the associated member of the door and wall combination. The valves, however, require an enlarged cavity portion enclosed by a removable cover plate which must be removed for access and replaced. In the present teachings a simple hinge closure structure is provided utilizing a spring and an adjustment rod. The adjustment rod is selectively operable for varying the compression of the spring whereby the rate of closure can be adjusted. One end of the adjustment rod is fixed to and easily, externally accessible at one of the hinge members. The adjustment rod has an end structure such that it can be threaded more or less into a cooperating member by a common tool, i.e. Allen wrench, screw driver, etc. whereby the adjustment can be made. Thus the present teachings provides a simple self-closing invisible hinge construction in which the closure rate can be selectively adjusted by a readily, externally accessible member.

According to the principles of the present teachings, a new and unique self-closing invisible hinge is provided having a construction by which the closure force can be selectively adjustable by means readily accessible and external from the associated door and/or wall.

According to the principles of the present teachings, a new and unique self-closing invisible hinge is provided utilizing the compression of a spring to provide the closure force, whereby with the magnitude of the spring compression and hence closure force is selectively variable through a member readily, externally accessible at the hinge.

Moreover, more recently, there has been an increasing interest in providing and/or supplying electricity to articles, devices, or systems disposed on or in various closures. For example, many closures today employ electronic locking devices that rely on electrical power for operation and wired connection to a central system for communication (i.e. key-card hotel locks, fingerprint recognition systems, and the like). Because of this interest, the present teachings provide a self-closing invisible hinge structure that is further capable of routing, protecting, and housing electrical and/or communication-type wiring therethrough.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
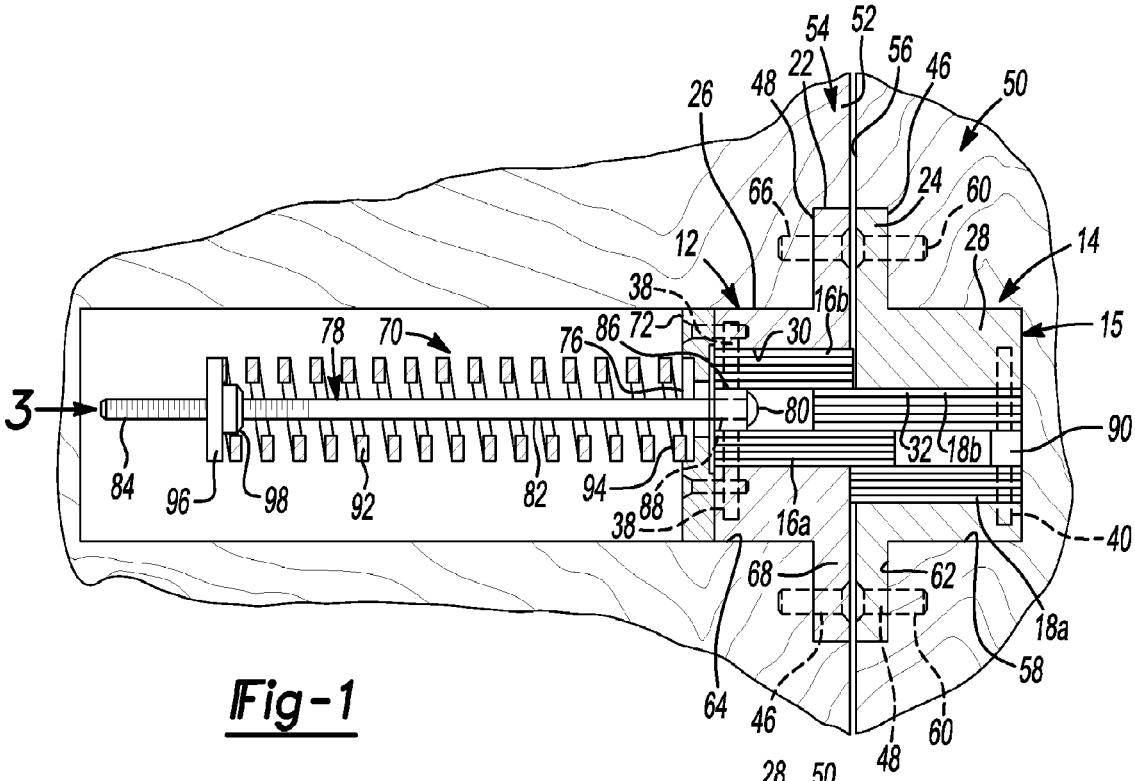
FIG. 1 is a side elevational view with some parts shown in section of an invisible hinge and self-closing structure with a door and associated wall or other mounting structure partially shown in section, with the hinge and hence door in their closed positions.

Example embodiments will now be described more fully with reference to the accompanying drawings.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Referring now to the drawings, in some embodiments, an Invisible hinge 10 is shown and includes a pair of butt members or hinge bodies 12 and 14 connected by a link assembly 15. The assembly 15 includes two pairs of link members with link members 16*a* and 16*b* being one pair and link members 18*a* and 18*b* being the other pair. The link members 16*a*, 16*b*, 18*a* and 18*b* are similarly constructed and are formed from a lamination of a plurality of relatively thin sheet metal plates with the opposite outer layers being coated to provide surfaces having good lubricity. In the form of the teachings as shown the opposite outer layers were of a relatively thin nylon construction with the inner layers being of a thicker sheet metal construction. The links 16*a*, 16*b* and 18*a*, 18*b* are generally V-shaped with the outer edge surfaces angulated generally at an angle 'a' of around 120° relative to each other (see FIG. 5). The links 16*a*, 16*b* and 18*a*, 18*b* have a short and a long leg portion and are pivotally connected together at their apexes via a rivet pin 20 which is headed at its opposite ends to hingedly connect the links 16*a*, 16*b* and 18*a*, 18*b* together as the link assembly 15 (see FIG. 5). In this regard the first pair of links 16*a* and 16*b* are interleaved with the second pair of links 18*a* and 18*b*.

The hinge bodies 12 and 14 are identically constructed and each has an elongated mounting plate portion 22 and 24, respectively, and a reduced size extension portion 26 and 28, respectively. Generally L-shaped slots or openings 30 and 32 extend across the front face of the mounting plate portion and through one side of each of the hinge bodies 12 and 14, respectively. The link assembly 15 has opposite ends located within the openings 30 and 32 with the ends of the short leg portions of links 16*a* and 16*b* pivotally connected to hinge body 12 via a fixed pivot pin 34 extending through aligned openings 35, 37 in extension portion 26 and in links 16*a* and 16*b*. Likewise, the ends of the short leg portions of the links 18*a* and 18*b* are pivotally connected to hinge body 12 via a fixed pivot pin 36 extending through aligned openings 35, 37 in extension portion 26 and in links 18*a* and 18*b*.

Figure 5:
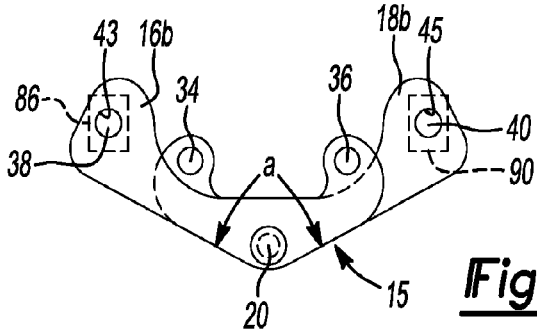
FIG. 5 is a top elevational view of a link assembly shown in the self closing hinge of FIGS. 1-4.

The opposite ends of the long leg portions of the first pair of links 16*a* and 16*b* are pivotally connected together via a movable guide pin 38 extending through aligned openings 43 while the opposite ends of the of the long leg portions of the second pair of links 18*a* and 18*b* are pivotally connected together via a movable guide pin 40 extending through aligned openings 45 (see FIG. 5).

Figure 4:
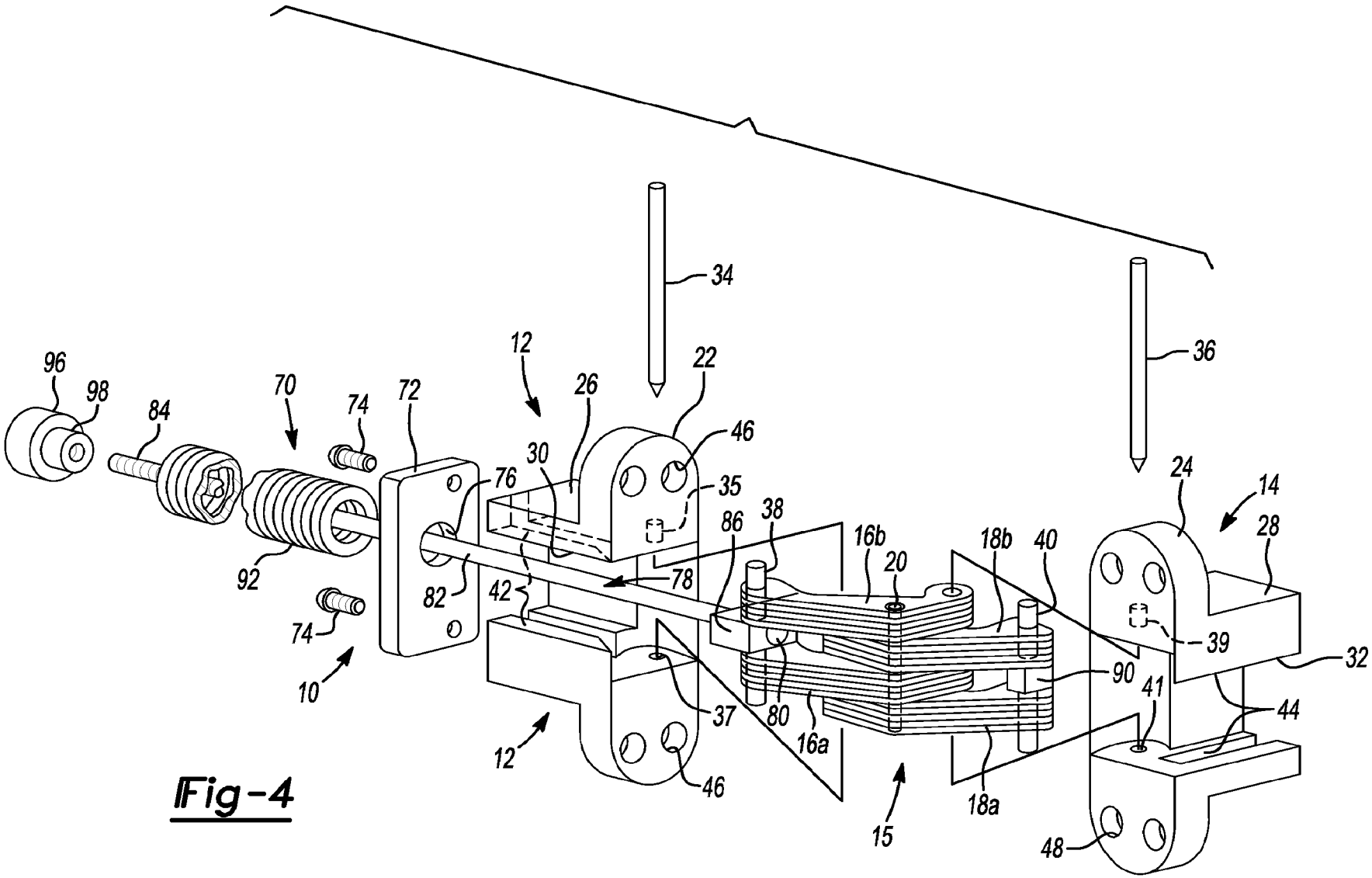
FIG. 4 is a pictorial, partially exploded, view with some parts shown broken away and in section of the invisible hinge and self-closing structure of FIGS. 1-3 with the hinge in a 90° open position.

The extreme ends of guide pin 38 extend outwardly from opposite sides of links 16*a* and 16*b* and are guidingly located in guide channels 43 formed within the upper and lower surfaces of opening 30. Similarly the extreme ends of guide pin 40 extend outwardly from opposite sides of links 18*a* and 18*b* and are guidingly located in guide channels 44 formed within the upper and lower surfaces of opening 32. In this way the link assembly 15 and hinge bodies 12 and 14 are connected together such that the hinge bodies 12 and 14 can be moved to a closed position i.e. in which the hinge bodies 12 and 14 are in face to face, closed alignment (see FIG. 1), or moved to open positions including a 90° open position (FIG. 4) or to a 180° open position i.e. in which the hinge bodies 12 and 14 are swung outwardly to be located in a side-by-side fully open relationship (see FIG. 2). In this regard the pairs of links 16*a*, 16*b* and 18*a*, 18*b* will, in a sense, be folded together inwardly into a nested position in the openings 30 and 32 of hinge bodies 12 and 14, respectively, in the closed condition and will be folded outwardly from openings 30 and 32 into an open position in the open condition. Mounting holes 46 in the mounting plate portion 22 and mounting holes 48 in plate portion 24 facilitate mounting of the hinge bodies 12 and 14, respectively, to associated members to be hinged together.

As shown in the drawings, the invisible hinge 10 is adapted to hinge a door 50 to the end 52 of a wall 54. Thus the confronting end 56 of door 50 is recessed as at 58 to receive the extension portion 28 of hinge body 14 and be secured thereto via threaded fasteners 60 through mounting holes 48. The recess 58 has an enlarged stepped portion 62 to secure the mounting plate portion 24 to provide a generally flush surface. The wall 54 is generally hollow but has its end 52 formed with an opening 64 to receive the extension portion 26 of hinge body 12 and be secured to the end 52 via threaded fasteners 66 through mounting holes 46. An enlarged stepped portion 68 about the wall opening 64 receives the mounting plate portion 22 to provide a generally flush surface.

The preceding describes an invisible hinge structure generally operating in the manner shown and described in the referenced United States patents. Of course, a plurality of hinges could be used to secure the door 50 to the wall 54.

In some embodiments, the invisible hinge 10 has been modified to operate with a closing structure 70 such that it is self-closing. Thus an end plate 72 is secured to the end of extension portion 26 of hinge body 12 via a pair of threaded fasteners 74. The end plate 72 generally closes the open end of through opening 30 of hinge body 12 but has a through bore 76 aligned therewith for a purpose to be seen. An elongated adjustment rod 78 has an enlarged head 80 at its outer end and a shank portion 82 with a threaded portion 84 at its inner end. The movable pivot pin 38 has an enlarged center portion 86 adapted to be located between the movable ends of links 16*a* and 16*b* and has a transversely extending through bore 88 adapted to receive the shank portion 82 of adjustment rod 78 in clearance relationship. The enlarged head 80 will then engage the center portion 86. The enlarged center portion 86 also helps to maintain the desired alignment and support the associated ends of the links 16*a*, 16*b*. The guide pin 40, at the moving ends of the links 18*a* and 18*b*, is also formed to have an enlarged center portion 90 which also helps to maintain the desired alignment and support the associated moving ends of the links 18*a*, 18*b*.

A helical coil spring 92 is located around the shank portion 82 of adjustment rod 78 and has one end in abutment with the end plate 72 and located within a counter bore 94. The counter bore 94 acts to pilot and positively hold the associated end of the spring 92 in the desired position about the shank portion 82 of adjustment rod 78. The opposite end of the spring 92 is engaged with a retaining ring 96 which is in threaded engagement with the threaded end portion 84 of the adjustment rod 78. A reduced diameter portion 98 of retaining ring 96 fits within the associated end of spring 92 to pilot that end of the spring 92 relative to the retaining ring 96.

The self closing structure 70 can be readily located within the hollow space or a suitable cavity in the wall 54 and inserted from the end 52 through the wall opening 64. Similarly where the associated door is of a hollow construction the self closing structure 70 could be readily located in the hollow space in the door. Note that the area of projection of the extension portions 26 and 28 does not extend outside of the periphery of the respective mounting plate portions 22 and 24. In this regard, it should further be noted that the area of projection of the outer surface of the self closing structure 70 does not extend outside of the periphery of the area of the extension portion 26. In this way the wall opening 64 through the end 52 of wall 54 need be no larger than required to accept the extension portion 26 of hinge body 12. This results in a compact structure and simplifies assembly of the hinge 10 and self closing structure 70 to the wall 54 and door 50.

Figure 2:
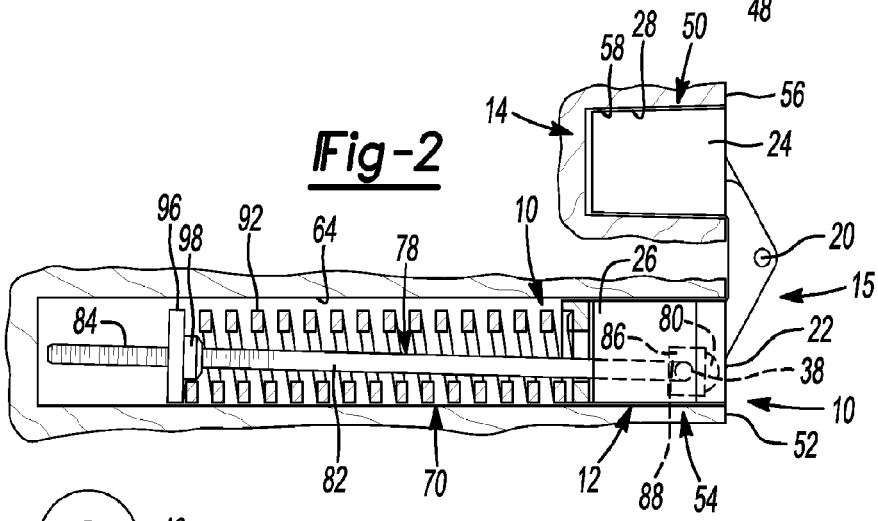
FIG. 2 is a top elevational view of the structure of FIG. 1 with the self closing hinge and hence door shown in a full, 180° open position.
Figure 3:
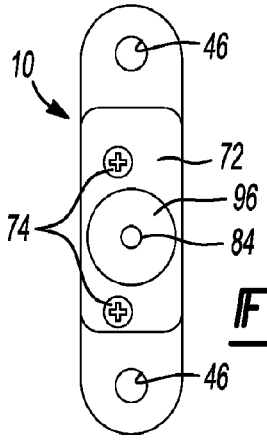
FIG. 3 is an end elevational view of the self closing hinge structure of FIG. 2 taken generally in the direction of the Arrow 3 in FIG. 1.

The initial compressive force of spring 92 will normally bias the door 50 to its closed position (FIG. 1). When the door 50 is opened, the compressive force on the spring 92 is increased. Thus when the door 50 is released the compressive force of spring 92 acting, through the pivotal connections of hinge bodies 12 and 14 will move the door 50 back to its closed position. The compression of the spring 92 can be varied by threading the retaining ring 96 more or less onto the threaded end portion 84 of adjustment rod 78. Note that the door 50 can be opened to a 180° open position (FIG. 2).

The enlarged head 80 of the adjustment rod 78 is formed with an irregular depression or surface such as a cross slot or a hexagonally shaped cavity. In this way the adjustment rod 78 can be manipulated by a screw driver, an Allen head wrench, etc. In the form of the teachings shown the head 80 is of a button head construction with the cavity shaped to accept a standard Allen head wrench. Other suitable shapes could be provided. In order to select the desired closure force of the spring 92, the magnitude of its compression can be varied simply by rotating the adjustment rod 78 whereby the retaining ring 96 will be moved along the threaded end portion 84 to increase or decrease that compressive force. Thus in this way the closure force on the invisible hinge 10 and hence on door 50 can be selectively varied. The force of the spring 92 against the retaining ring 96 will inhibit rotation of the retaining ring 96 with the adjustment rod 80. Note that the closure force adjustment can be readily made since the enlarged head 80 of the adjustment rod 78 is readily accessible externally of the wall 54 and/or door 50.

In some embodiments, as illustrated in FIGS. 6-12, invisible hinge 10 can be configured to comprise a plurality of electrical wires extending therethrough. These electrical wires 100 can be routed and contained within portions of invisible hinge 10 as shown, such as links 16*a* and 18*b*. In this regard, links 16*a* and 18*b* can be structured to include and/or define a thicker link portion. For example, in some embodiments, links 16*a* and 18*b* can comprise 6 mm links having an arcuate wire routing system extending therethrough. This arcuate wire routing system can define smooth transitions so that binding force on the wires can be minimized or eliminated.

Figure 6:
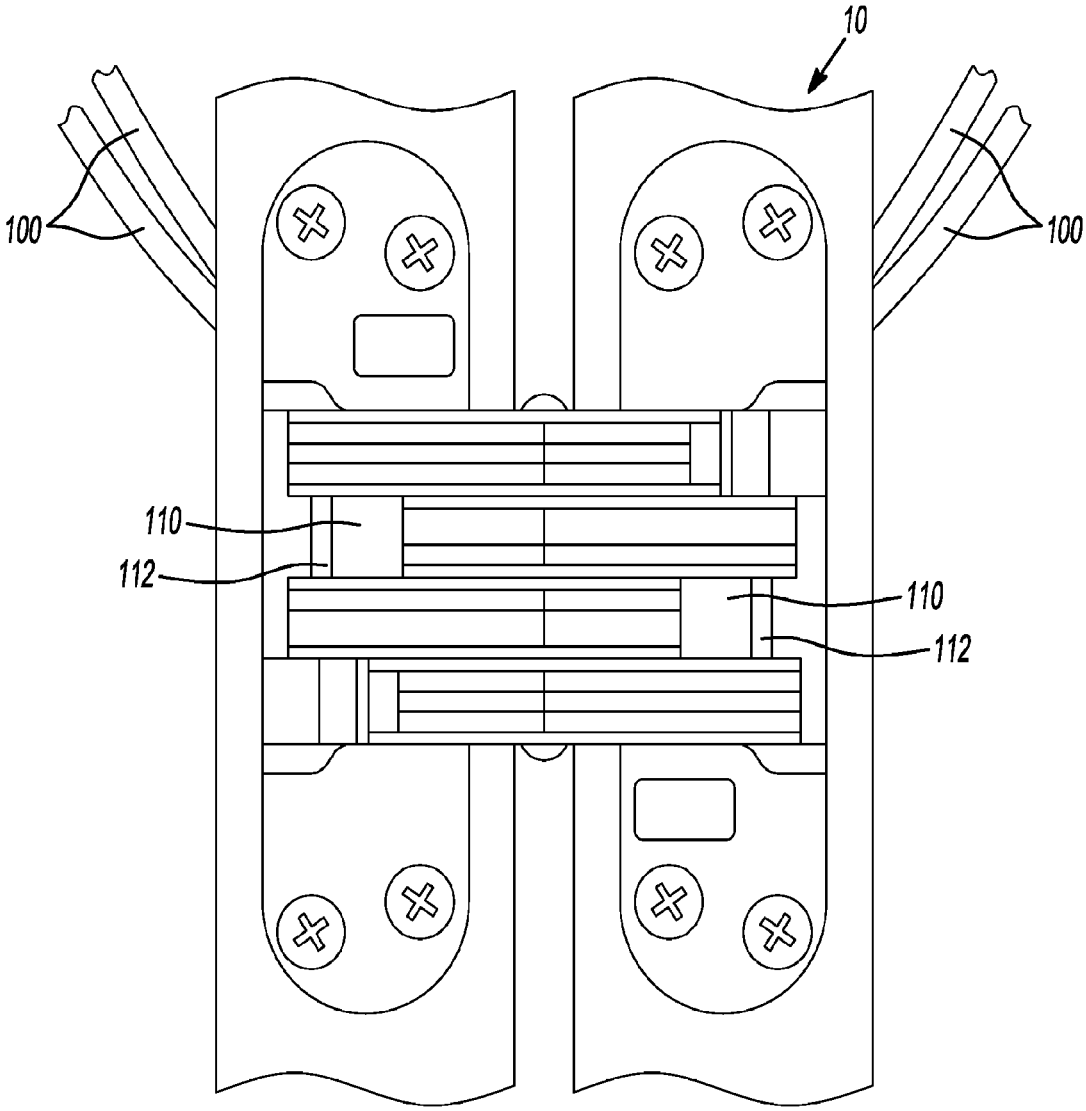
FIG. 6 is a front view of an invisible hinge and self-closing structure with a door and associated mounting structure, with the hinge and hence door in their opened position.
Figure 7:
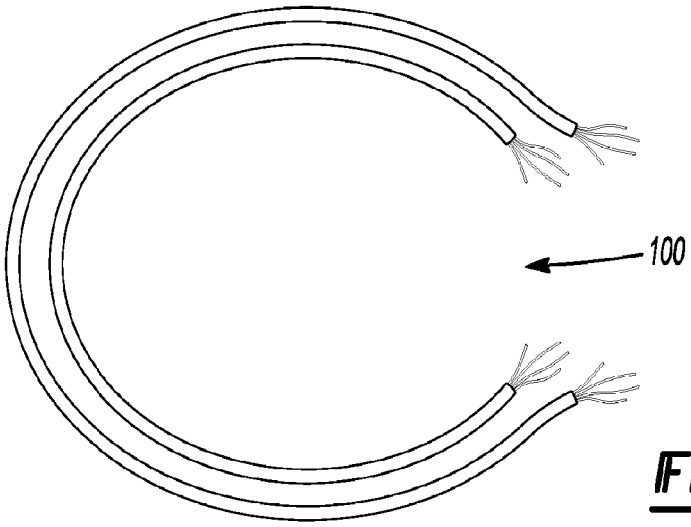
FIG. 7 is a top elevational view of an embedded wire for use with the structure of FIG. 6.
Figure 8:
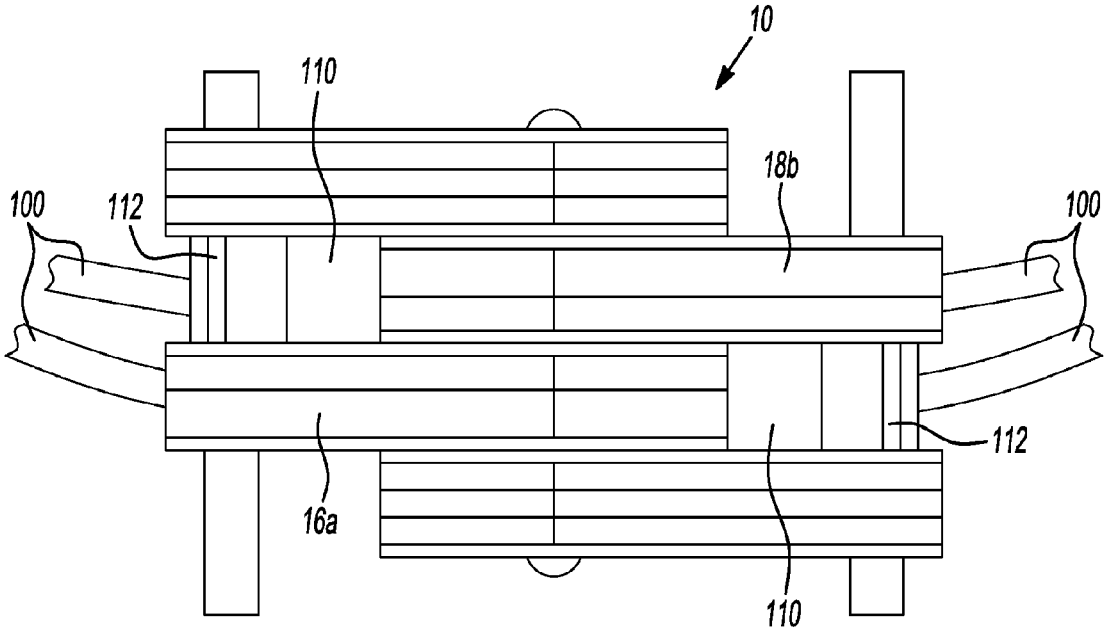
FIG. 8 is a front view of a link device with the embedded wires of the structure of FIG. 6.
Figure 9:
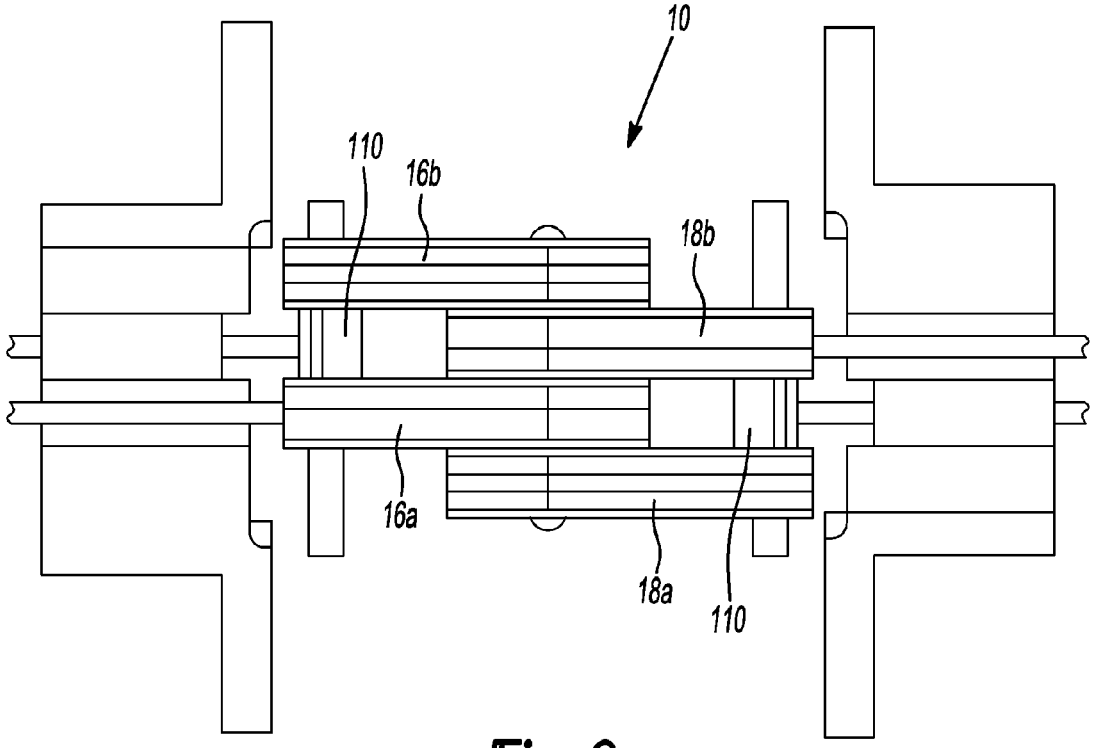
FIG. 9 is an exploded front view of the link device of FIG. 8.
Figure 10:
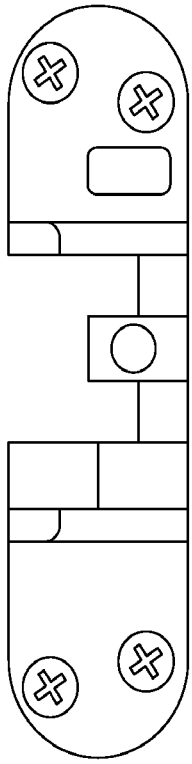
FIG. 10 is a front view of a hinge body according to the present teachings.
Figure 11:
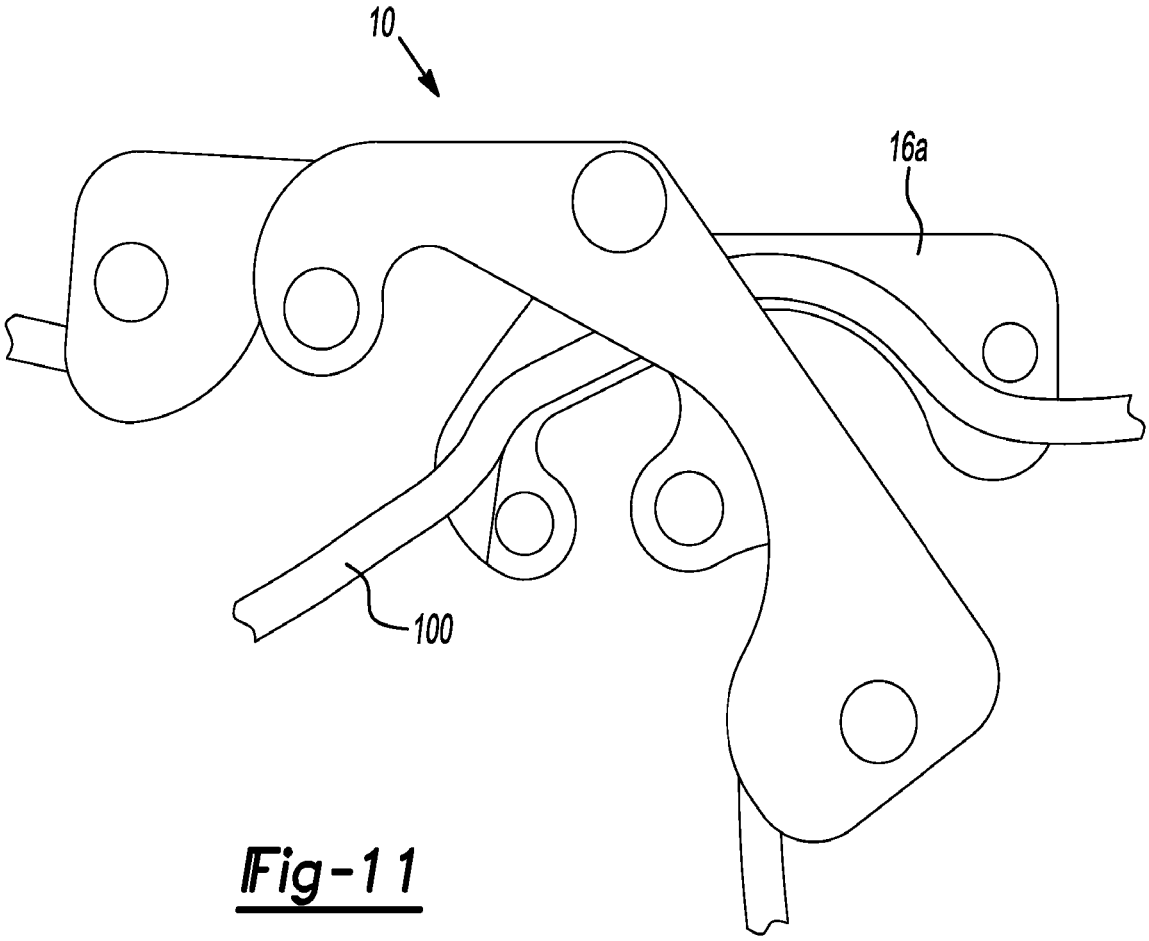
FIG. 11 is a top elevational view of a link device showing the embedded wire disposed in a channel of a first hinge body.
Figure 12:
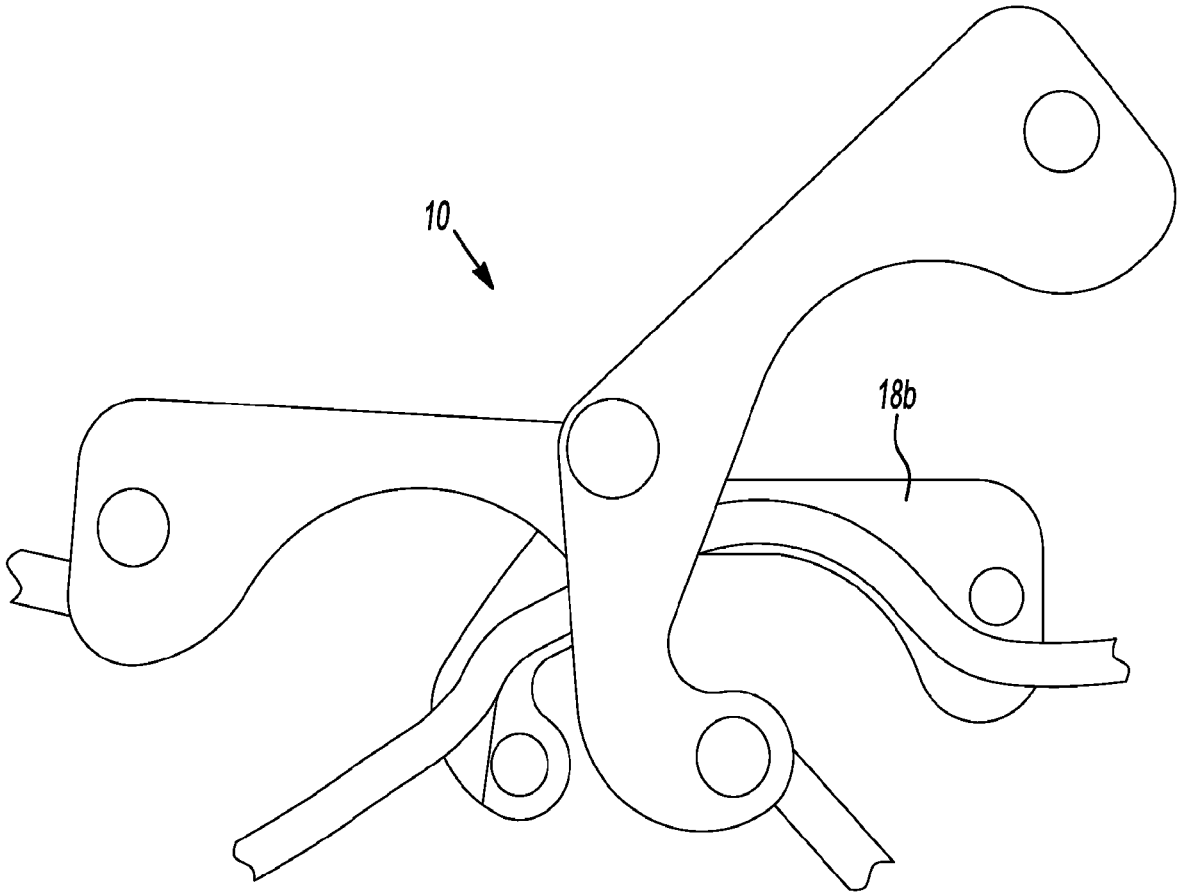
FIG. 12 is a top elevational view of a link device showing the embedded wire disposed in a channel of a second hinge body.

Additionally, as illustrated in FIGS. 6, 8, and 9, invisible hinge 10 can comprise wire cover plates 110 disposed between links 16*a* and 16*b* and between links 18*a* and 18*b*. These wire cover plates 110 can serve to conceal from view the wires and further protect the wires from being tampered with. Pins 112 can extend between links 16*a* and 16*b* and between links 18*a* and 18*b* to further reinforce wire cover plates 110 during operation.

By routing electrical wiring through invisible hinge 10, household or building power can be supplied to devices mounted in or on the door. In this way, electrical lock features, alarm devices, powered viewing devices, lighting, intercom, etc. can be effectively and reliably routed to the door. It should be appreciated that these wires can be used in any electrical capacity, including low voltage and/or switching applications.

This embodiment was tested with the recommended standard of 0.016 ampere electric current for more than 350,000 cycles without breaking any wire. It was determined that the selected wires are both durable and flexible, and the design of the present teachings permitted at least 470,000 cycles at 0.024 ampere and then another 100,000 cycles at an increased electric current of 0.032 ampere without breaking.

The foregoing description of the embodiments has been provided for purposes of illustration and description. It is not intended to be exhaustive or to limit the teachings. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the teachings, and all such modifications are intended to be included within the scope of the teachings.

What is claimed is:

1. A self-closing invisible hinge for supporting a door to a mounting structure for swinging movement between a closed and an opened position and for urging and returning the door to its closed position from its opened position, said self-closing invisible hinge comprising:

a pair of hinge bodies having a front portion and a rear portion, each of said pair of hinge bodies being connectable to the associated one of the door and the mounting structure with each said front portion facing outwardly from the associated one of the door and mounting structure;

a link device connected to said pair of hinge bodies for permitting swinging movement of said pair of hinge bodies relative to each other between its closed and opened positions, said link device having at least one channel extending through at least one of said pair of hinge bodies, said at least one channel extending from a position generally adjacent to the door to a position generally adjacent the mounting structure, said at least one channel being concealed when viewing said front portion of said pair of hinge bodies;

a closing device operatively connected between said link device and one of said pair of hinge bodies for urging said link device and said pair of hinge bodies to the closed position, said closing device having a spring device for providing a spring bias between said link device and said one of said pair of hinge bodies for urging said link device and said pair of hinge bodies to the closed position;

an adjustment device operatively connected with said spring device, said adjustment device selectively varying the magnitude of said spring bias of said spring device, said spring device and said adjustment device extending rearwardly from said rear portion of said one of said pair of hinge bodies and adapted to be located and enclosed within an opening in the associated one of the door and mounting structure; and an electrical wire extending through said at least one channel of said link device and extending to said rear portion of said pair of hinge bodies, said electrical wire providing electrical communication therethrough.

2. The self-closing invisible hinge according to claim 1 wherein said adjustment device comprises an adjustment member having an adjustment portion externally accessible to a user through said front portion of said one of said pair of hinge bodies at said link device when said link device is in the opened position whereby the magnitude of said spring bias is selectable by manual manipulation by the user of said adjustment member via said adjustment portion.

3. The self-closing invisible hinge according to claim 1 wherein said spring device comprises a coil spring, said adjustment member of said adjustment device being an elongated rod extending through said coil spring and terminating at its forward end in a head portion having an engaging surface externally accessible to the user through said front portion of said one of said pair of hinge bodies at said link device.

4. The self-closing invisible hinge according to claim 3 wherein said adjustment device comprises a retaining member engaging the rearward end of said coil spring and having a threaded bore, said adjustment rod having its rearward end threadably engaged with said threaded bore whereby rotational movement of said adjustment rod relative to said retaining member will vary said spring bias.

5. The self-closing invisible hinge according to claim 4 wherein said adjustment device comprises a connecting member connected to said link device and to said forward end of said adjustment rod.

6. The self-closing invisible hinge according to claim 5 wherein said link device comprises at least two link members and a pivot device connecting said at least two link members together, each of said pair of hinge bodies having an opening for receiving said at least two link members when in the closed position, further comprising:

a guide device connecting each of said at least two link members to a different one of said pair of hinge bodies whereby said at least two link members are guided to positions in and out of the associated ones of said opening, said guide device including pins connected to said at least two link members, said connecting member including one of said pins.

7. The self-closing invisible hinge according to claim 6 wherein each of said pair of hinge bodies including an enlarged mounting plate defining said front portion at its forward end and a rearwardly extending extension portion of reduced cross section defining said rear portion at its rearward end, said adjustment device having a cross section when projected against said extension portion being generally within the confines of the projected area of the periphery of said extension portion.

8. The self-closing invisible hinge according to claim 1 wherein said at least one channel is arcuately shaped.

9. The self-closing invisible hinge according to claim 1, further comprising:

at least one wire cover plate disposed adjacent said at least one channel extending through said at least one of said pair of hinge bodies, said at least one wire cover plate concealing said electrical wire extending from said at least one channel to the associated one of said position generally adjacent to the door and said position generally adjacent the mounting structure.

10. A self-closing invisible hinge for supporting a door to a mounting structure for swinging movement between a closed and an opened position and for urging and returning the door to its closed position from its opened position, said self-closing invisible hinge comprising:

a pair of hinge bodies having a front portion and a rear portion;

a fastening device connecting each of said pair of hinge bodies to the associated one of the door and the mounting structure with each said front portion facing outwardly from the associated one of the door and mounting structure;

a link device connected to said pair of hinge bodies for permitting swinging movement of said pair of hinge bodies relative to each other and hence swinging movement of the door relative to the mounting structure between its closed and opened positions, said link device having at least one channel extending through at least one of said pair of hinge bodies, said at least one channel extending from a position generally adjacent to the door to a position generally adjacent the mounting structure, said at least one channel being concealed when viewing said front portion of said pair of hinge bodies;

a closing device operatively connected between said link device and one of said pair of hinge bodies for urging said link device and said pair of hinge bodies to the closed position, said closing device having a spring device for providing a spring bias between said link device and said one of said pair of hinge bodies for urging said link device and said pair of hinge bodies to the closed position, said closing device further having an adjustment device operatively connected with said spring device and being operable for selectively varying the magnitude of said spring bias, said spring device and said adjustment device extending rearwardly from said rear portion of said one of said pair of hinge bodies and adapted to be located and enclosed within an opening in the associated one of the door and mounting structure, said adjustment device including an adjustment member having an adjustment portion externally accessible to a user through said front portion of said one of said pair of hinge bodies at said link device when said link device is in the opened position whereby the magnitude of said spring bias is selectable by manual manipulation by the user of said adjustment member via said adjustment portion; and an electrical wire extending through said at least one channel of said link device and extending to said rear portion of said pair of hinge bodies, said electrical wire providing electrical communication therethrough.

11. The self-closing invisible hinge according to claim 10 wherein said spring device comprises a coil spring, said adjustment member of said adjustment device being an elongated rod extending through said coil spring and terminating at its forward end in a head portion having an engaging surface externally accessible to the user through said front portion of said one of said pair of hinge bodies at said link device.

12. The self-closing invisible hinge according to claim 11 wherein said adjustment device comprises a retaining member engaging the rearward end of said coil spring and having a threaded bore, said adjustment rod having its rearward end threadably engaged with said threaded bore whereby rotational movement of said adjustment rod relative to said retaining member will vary said spring bias.

13. The self-closing invisible hinge according to claim 12 wherein said adjustment device comprises a connecting member connected to said link device and to said forward end of said adjustment rod.

14. The self-closing invisible hinge according to claim 13 wherein said link device comprises at least two link members and a pivot device connecting said at least two link members together, each of said pair of hinge bodies having an opening for receiving said at least two link members when in the closed position, further comprising:

a guide device connecting each of said at least two link members to a different one of said pair of hinge bodies whereby said at least two link members are guided to positions in and out of the associated ones of said opening, said guide device including pins connected to said at least two link members, said connecting member including one of said pins.

15. The self-closing invisible hinge according to claim 14 wherein each of said pair of hinge bodies including an enlarged mounting plate defining said front portion at its forward end and a rearwardly extending extension portion of reduced cross section defining said rear portion at its rearward end, said adjustment device having a cross section when projected against said extension portion being generally within the confines of the projected area of the periphery of said extension portion.

16. The self-closing invisible hinge according to claim 10 wherein said at least one channel is arcuately shaped.

17. The self-closing invisible hinge according to claim 10, further comprising:

at least one wire cover plate disposed adjacent said at least one channel extending through said at least one of said pair of hinge bodies, said at least one wire cover plate concealing said electrical wire extending from said at least one channel to the associated one of said position generally adjacent to the door and said position generally adjacent the mounting structure.

18. An invisible hinge for supporting a door to a mounting structure for swinging movement between a closed and an opened position, said invisible hinge comprising:

a pair of hinge bodies having a front portion and a rear portion, each of said pair of hinge bodies being connectable to the associated one of the door and the mounting structure with each said front portion facing outwardly from the associated one of the door and mounting structure;

a link device connected to said pair of hinge bodies for permitting swinging movement of said pair of hinge bodies relative to each other between its closed and opened positions, said link device having at least one channel extending through at least one of said pair of hinge bodies, said at least one channel extending from a position generally adjacent to the door to a position generally adjacent the mounting structure, said at least one channel being concealed when viewing said front portion of said pair of hinge bodies, said link device having at least two link members and a pivot device connecting said at least two link members together, each of said pair of hinge bodies having an opening for receiving said at least two link members when in a closed position;

a guide device connecting each of said at least two link members to a different one of said pair of hinge bodies whereby said at least two link members are guided to positions in and out of the associated ones of said opening, said guide device including pins connected to said at least two link members, said connecting member including one of said pins; and an electrical wire extending through said at least one channel of said link device and extending to said rear portion of said pair of hinge bodies, said electrical wire providing electrical communication therethrough.

19. The invisible hinge according to claim 18, further comprising:

a closing device operatively connected between said link device and one of said pair of hinge bodies for urging said link device and said pair of hinge bodies to a closed position, said closing device providing a bias between said link device and said one of said pair of hinge bodies for urging said link device and said pair of hinge bodies to the closed position.

20. The invisible hinge according to claim 19, further comprising:

an adjustment device operatively connected with said closing device, said adjustment device selectively varying the magnitude of said bias of said closing device, said closing device and said adjustment device extending rearwardly from said rear portion of said one of said pair of hinge bodies and adapted to be located and enclosed within an opening in the associated one of the door and mounting structure.

21. The invisible hinge according to claim 20 wherein said adjustment device comprises an adjustment member having an adjustment portion externally accessible to a user through said front portion of said one of said pair of hinge bodies at said link device when said link device is in the opened position whereby the magnitude of said bias is selectable by manual manipulation by the user of said adjustment member via said adjustment portion.

22. The invisible hinge according to claim 18 wherein each of said pair of hinge bodies including an enlarged mounting plate defining said front portion at its forward end and a rearwardly extending extension portion of reduced cross section defining said rear portion at its rearward end.

23. The invisible hinge according to claim 18 wherein said at least one channel is arcuately shaped.

24. The invisible hinge according to claim 18, further comprising:

at least one wire cover plate disposed adjacent said at least one channel extending through said at least one of said pair of hinge bodies, said at least one wire cover plate concealing said electrical wire extending from said at least one channel to the associated one of said position generally adjacent to the door and said position generally adjacent the mounting structure.

* * * * *